United States Patent [19]

Zimmermann

[11] 4,080,112

[45] Mar. 21, 1978

[54] MAGNETICALLY-COUPLED PUMP

[75] Inventor: Frederick Norman Zimmermann, Deerfield, Ill.

[73] Assignee: March Manufacturing Company, Glenview, Ill.

[21] Appl. No.: 654,915

[22] Filed: Feb. 3, 1976

[51] Int. Cl.[2] ..... F04B 17/00

[52] U.S. Cl. ..... 417/420; 415/104; 415/215; 417/365; 417/366

[58] Field of Search ..... 417/53, 368, 367, 372, 417/420, 365, 366, 369; 415/104–106; 310/60, 60 A, 86, 87, 104

[56] References Cited

U.S. PATENT DOCUMENTS

| | | | |
|---|---|---|---|
| 1,114,727 | 10/1914 | Breeze | 417/368 |
| 1,130,616 | 3/1915 | Lorenz | 415/106 |
| 1,180,587 | 4/1916 | Ingram | 415/106 |
| 2,972,308 | 2/1961 | Haggerty | 310/86 X |
| 3,195,467 | 7/1965 | Collet | 417/420 |
| 3,205,827 | 9/1965 | Zimmermann | 417/420 |
| 3,238,878 | 3/1966 | Martin | 417/420 X |
| 3,256,829 | 6/1966 | Schneider | 310/86 X |
| 3,520,642 | 7/1970 | Fulton | 417/420 |
| 3,545,892 | 12/1970 | Zimmermann | 417/420 X |

*Primary Examiner*—William L. Freeh
*Assistant Examiner*—Edward Look
*Attorney, Agent, or Firm*—Callard Livingston

[57] ABSTRACT

A high-volume, heavy-duty, magnetically-coupled centrifugal pump having flow-dividing duct configurations directing the influx to opposite sides of the impeller as the result of assembly of mating body sections defining a multi-chambered pump body and including major partitioning web and cavity configurations with cooperative plate means affording certain inflow-chamber, shaft-support, and turbulence-suppressing chamber configurations operative to diminish turbulence volume and also block transfer of turbulence effects from the magnet rotor back to the impeller while permitting liquid to fill into the magnet chamber, the magnet rotor having web and passage configurations operative to force liquid and create pressure behind the rotor to create counterforces opposing certain thrust forces.

9 Claims, 10 Drawing Figures

MAGNETICALLY-COUPLED PUMP

In magnetically-coupled pumps the impeller is wholly sealed within the pump body to eliminate need for shaft seals, and an internal coupling magnet rotor connected to the impeller is driven entirely through magnetic flux coupling with a motor-driven external magnet rotating wholly outside of the pump body in a path surrounding the inner magnet.

In such pumps the internal magnet is commonly confined within a cup-shaped magnet chamber open on one side facing one side of the impeller and fully exposed to the pumped liquid such that the magnet rotor can create turbulence in the zone between itself and the impeller, so that it is desirable in general to keep the possible turbulence zone volumetrically as small as possible. In smaller pumps, turbulence can usually be tolerated, but in the larger size pumps such as that to which the present improvements are particularly applicable — one, for example, capable of an output of some 230 gallons per minute and driven by a motor running at about 3500 RPM and rated at 10 Horsepower — turbulence effects reach unacceptable magnitudes which impair both impeller and magnetic coupling effects to significant extent and cause rapid bearing damage.

In accordance with the invention, mating pump body sections define an impeller chamber containing a shaft-supported impeller with liquid intake at its opposite axial sides into which input liquid is directed by corresponding inflow channels afforded by integral dividing duct configurations completed by assembly of said body sections, one of which includes a partitioning web having opposite sides respectively proximate to a side of the impeller and an opening into a magnet rotor chamber confronting said web; the web including surrounding rim configurations creating a neutralizing chamber cavity or recess and including further shaft support configurations substantially within the recess of said neutralizing chamber; plate means being closely fitted about said shaft support configurations and in closing relation with said neutralizing chamber or cavity, such that liquid within the latter will be substantially confined and shielded from major turbulence effects, the web and plate having restrictive liquid-flow passages therethrough permitting liquid from the impeller chamber to fill into the neutralizing and magnet chambers, but preventing the exchange or communication of any substantial turbulence effects between the impeller and magnet rotor chambers.

In accordance with another aspect of the invention the impeller is provided with inflow chamber means confronting the liquid intakes at the respective opposite sides of the impeller, each said chamber communicating with a corresponding one of said inflow channels.

In accordance with a further aspect of the invention the inflow chambers are respectively formed by configurations which are part of different ones of said body sections.

In accordance with still another aspect of the invention one of the inflow chambers is formed by configurations which are part of said partitioning web and neutralizing chamber structure and the other inflow chamber is formed by configurations which are part of the mating first body section.

A still further feature conformably with the invention provides that the inflow chamber portion which is part of the neutralizing chamber web is axially aligned with and communicates into and through a part of said shaft support with shaft means from the impeller extending through said particular inflow chamber portion and said shaft support means and thence into engagement with the coupling magnet rotor in said third section or magnet chamber.

Conformably with yet another aspect of the invention a supplemental portion of said duct configurations which defines a part of said divided-flow configurations stands from said web portion of the neutralizing chamber structure into said neutralizing chamber and is substantially confined therein and shielded from turbulence effects by a closure wall or plate closing the cavity of said neutralizing chamber.

In accordance with a still further aspect of the invention the magnet rotor includes radial web portions extending across said magnet chamber into very close liquid-flow restricting proximity with surrounding cylindrical wall portions of the magnet chamber such that the rotor is axially sensitive to pressure variations on opposite sides thereof tending to shift the rotor axially and:or exert axial shift forces thereon, and accordingly an axially-acting counterforce is created on at least that side of the rotor which is remote from the plate by provision of liquid passage means extending through the rotor web in a generally axial direction operative to create liquid pressure in between the side of the rotor remote from said plate and a confronting wall portion of the magnet chamber.

Additional objects and utilitarian aspects of the functional and structural features of the disclosures will become apparent in the following description of a preferred embodiment thereof taken in view of the accompanying drawings in which.

Figure 1:
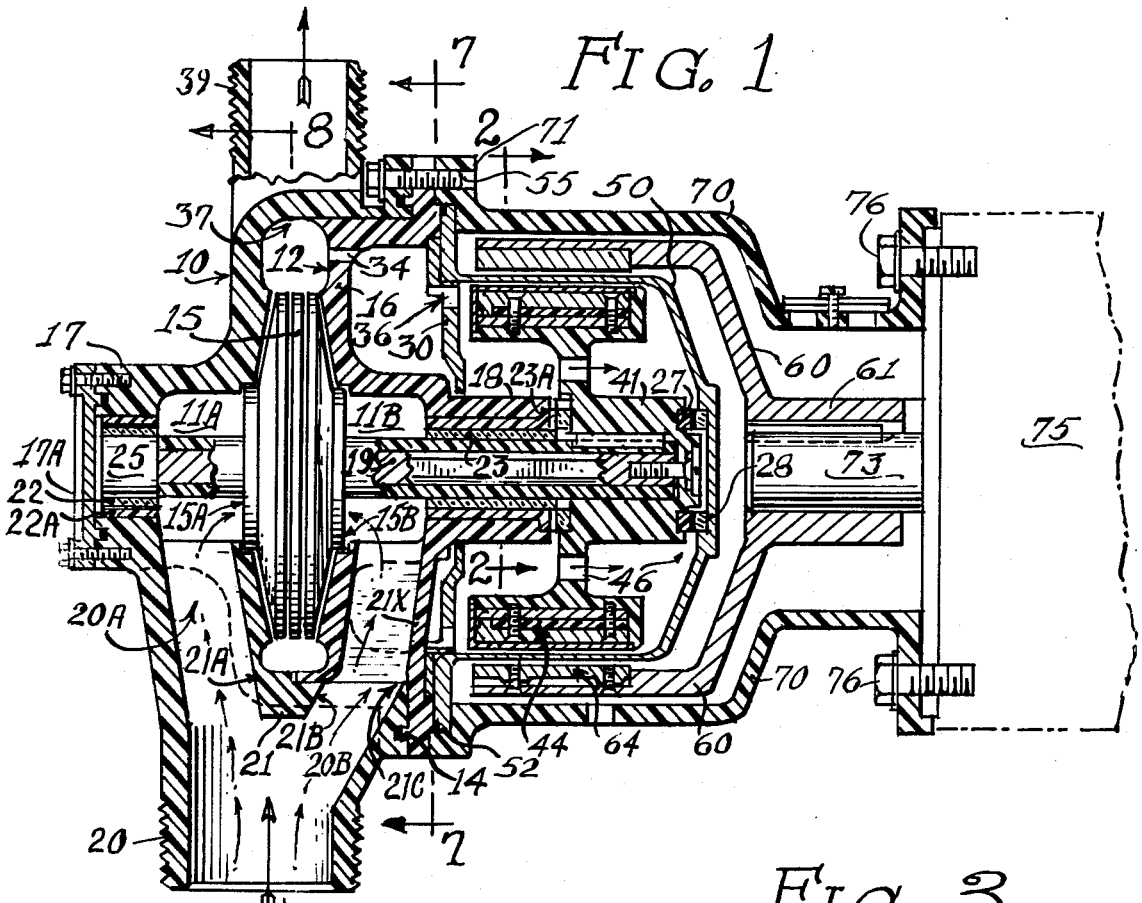
FIG. 1 is a vertical cross section through the pump in attachment to a driving motor shown fragmentally.
Figure 7:
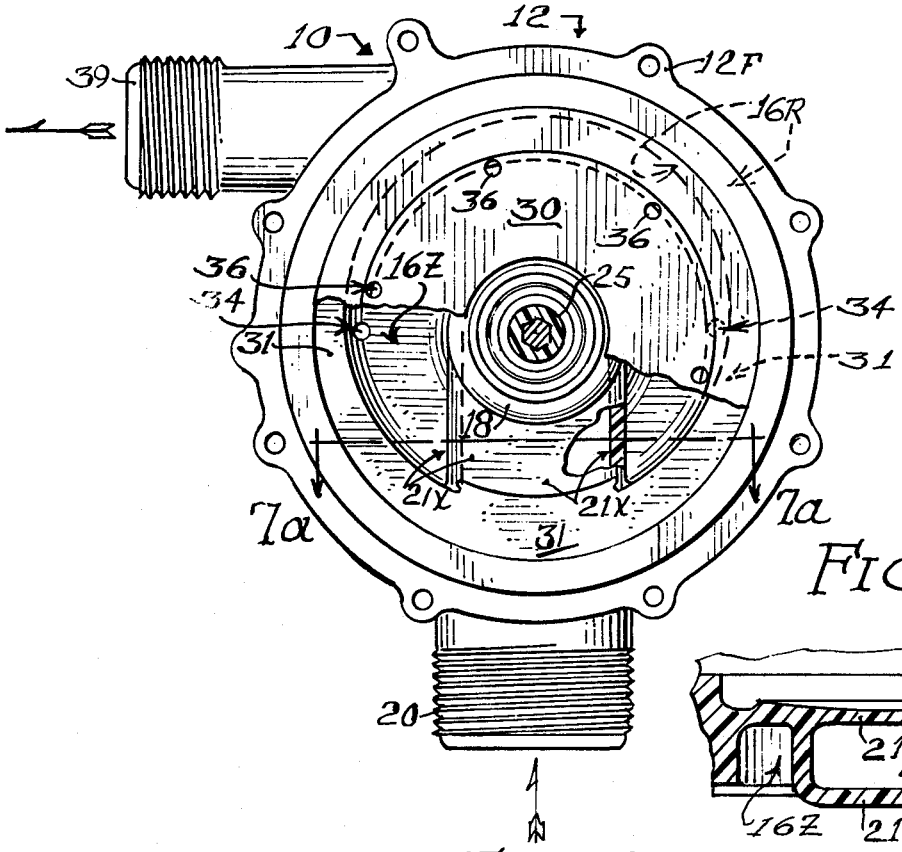
FIG. 7 is an elevational view of the magnet side of the second section of the pump body with parts shown in section, looking in the direction of lines 7—7 of FIG. 1.
Figure 7A:
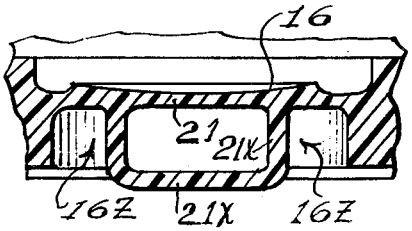
Figure 8:
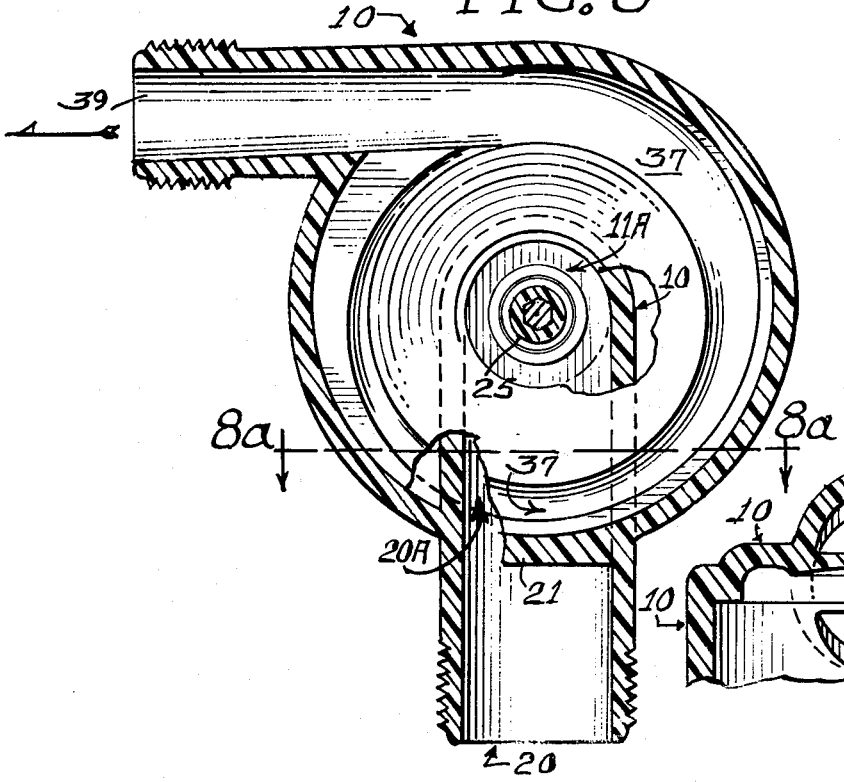
Figure 8A:
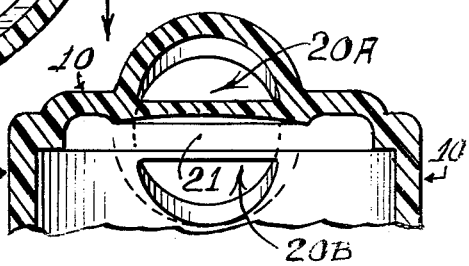

FIG. 7*a* is a horizontal sectional detail of a portion of the divided inlet structure looking along lines 7*a*—7*a* of FIG. 7;

FIG. 8 is a vertical section taken through the first body section of the pump looking in the direction of lines 8—8 of FIG. 1;

FIG. 8*a* is a horizontal sectional detail of another portion of the dividing duct configuration taken along lines 8*a*—8*a* of FIG. 8.

Figures 4, 5, 6:
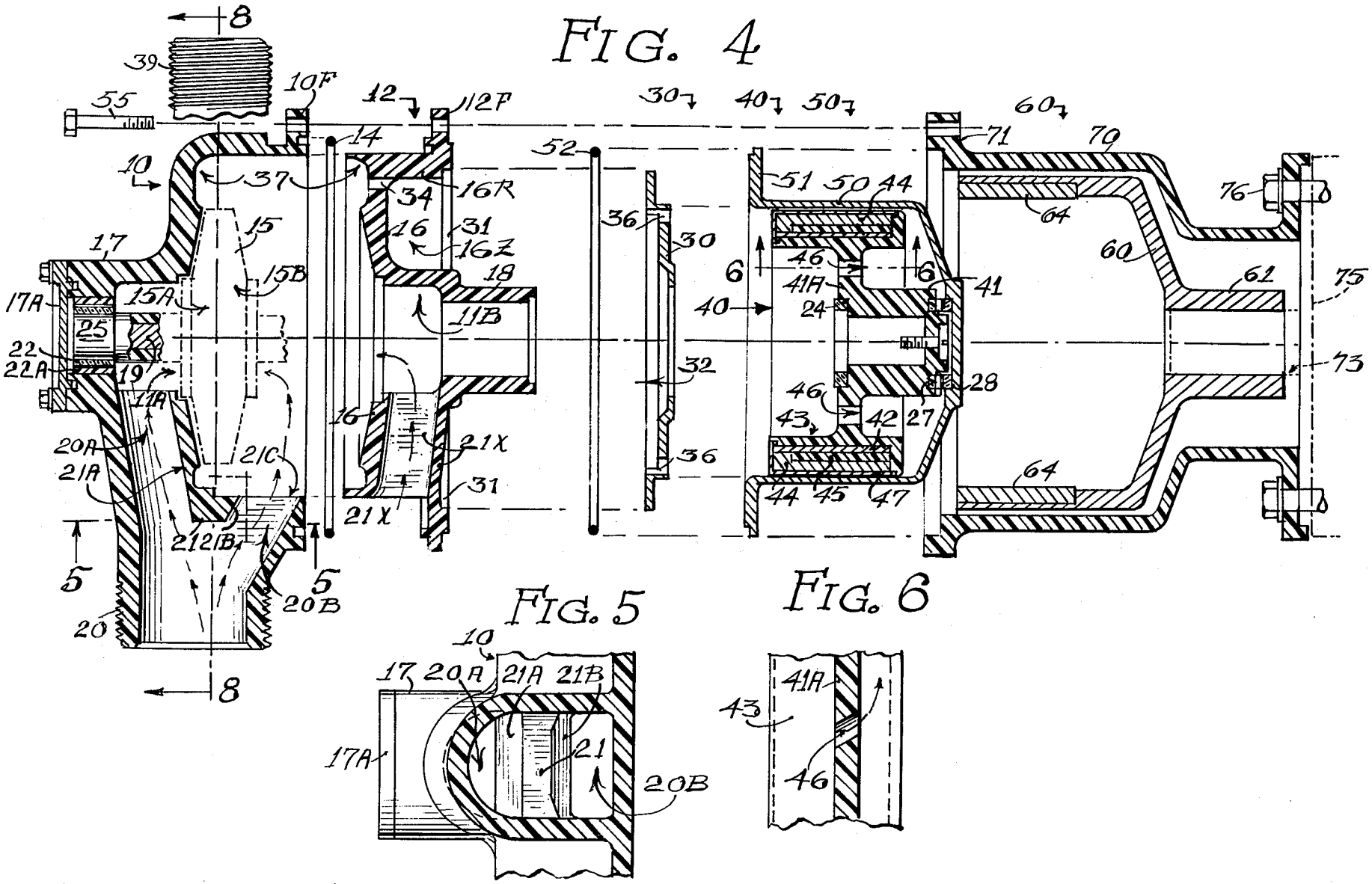
FIG. 4 is an exploded view of pump components seen in the assembly of FIG. 1.
FIG. 5 is a fragmentary sectional detail of a portion of the divided inlet taken along lines 5—5 of FIG. 4.
FIG. 6 is an enlarged fragmentary detail of a portion of the magnet rotor web taken along lines 6—6 of FIG. 4 and showing a counterforce pumping passage.

The character of the pump components depicted in the assembled state of FIG. 1 is more readily apparent from the exploded view of FIG. 4 wherein the pump is seen to be comprised of a first molded body section 10 and a mating second section 12 interfitting therewith, as at 13, with the sealing "O" ring 14 in between, FIG. 1, and a third body section in the form of a magnet rotor shell or separator chamber 50.

As viewed further in FIG. 4, the second body section includes a major partitioning web 16 from the central region of which projects a shaft-supporting configuration or protuberance 18 including a seating bore for composite insert bearing means such as shown at 22, 23, in FIG. 1, the web zone at the opposite or impeller side of this bearing protuberance also defining a cavity providing one of two hub inflow chambers 11A and 11B, also referred to as the "first" and "second" hub chambers, and respectively confronting the opposite hub inlets 15A and 15B in the impeller 15.

Continuing in view of FIG. 4, the first body section 10 includes an outer shaft bearing support 17 fitted with an external closure plate 17A and aligned with the aforesaid inner shaft and bearing support 18 as the journalling means for the common shaft structure 25 which carries both the impeller and the inner coupling magnet rotor 40 for conjoint rotation; still further configurations in this body section serving to define a large inlet nipple and duct 20 provided with flow-dividing means 21, 21A, 21B creating adjoining left- and right-hand liquid diverting paths or channels 20A and 20B which respectively lead into said first and second hub inflow chambers 11A and 11B, whereby to feed the inflowing liquid in increased volume to the dual impeller inlets 15A, 15B, parts of the aforesaid inflow chamber and duct configurations in the first body section being structurally completed by alignment with supplemental configurations in the companion body section as the result of joinder of these components, as will further appear. Thus, in FIG. 4 it will be seen that the second body section 12 has formed as an adjunct to the main dividing web configuration 16, salient duct portions 21X which constitute a supplemental extension of portions 21B of the dividing channel 20B, and which protrude substantially from the face of the web on its side opposite from the impeller and proximate to the magnetic drive means on the right, in order to afford adequate cross-sectional area for high-volume infeed to the impeller, this supplemental duct extension 21X merging and discharging at its upper terminus into the second hub inflow chamber 11B, and having its lower margins situated such that when the two body sections are in assembled relation the upper end margins 21C of the divided duct formation defining the lower portion of channel 20B, will be in juxtaposed alignment with 21X to complete this channel as an input path into hub chamber 11B.

Accordingly, the inflowing liquid from the inlet port and duct 20, as indicated by the diverging flow arrows in both FIGS. 1 and 4, divides into the left-hand or first hub inlet chamber 11A via channel 20A, and into the right-hand or second hub chamber 11B via channel 21B, 21X.

FIG. 8 depicts a cut-away view of the first body section 10 to illustrate still further portions of the flow-dividing structure 21, 21A along with portions of the inlet chamber 11A into which they lead, and also shows portions of the centrifugal volute 37 discharging the effluent into the outlet duct and port 39.

As a result of these structural arrangements the supplemental part 21X of channel 20B formed in the companion body section stands prominently from the lower portion of the face of the main partitioning web 16 of the neutralizing chamber 16Z in the manner seen in FIGS. 4 and 7, the latter view depicting parts of both of the body section 10 and 12 in assembly relationship to portray the extent to which this salient duct section 21X stands out into the cavity or chambered area 16Z formed by the web and its surrounding rim configuration 16R in accompaniment with the equally protuberant shaft supporting formation 18.

In general, magnetic coupling practices inherently require location of all bearing components relating to the impeller means interiorly of the pump housing, and the resulting structures commonly create additional turbulence since the bearing elements must utilize the pumped liquid for lubrication, and in many cases also for heat-exchange purposes, and various arrangements have been attempted to avoid added turbulence from such sources.

In accordance with the disclosed methods and construction, the duct configurations and bearing or shaft-supporting components which could contribute considerably to turbulence by reason of location or exposure in turbulence zones, are not restricted in size or location for such purposes, but are disposed in a confined volume of the liquid which becomes in effect a neutralized turbulence area, interposed between the two major sources of turbulence generation, the impeller chamber and the open-faced chamber which contains the rotating coupling magnet.

The chambered configuration 16Z formed by the main web 16 and its surrounding rim 16R, with assembly flange means 16F, affords a substantial volumetric area containing the salient and protuberant duct and shaft-supporting configurations which are proximate to and would ordinarily confront the turbulence zone existing at the open mouth of the chamber containing the magnet rotor 40; but this chambered area 16Z being closed off by diaphragm means in the form of a circular plate 30 seating onto ledge means 31 within rim 16R and having a central opening 32 fitting closely about the shaft-supporting structure 18 to minimize liquid movement into or out of the closed cavity or chamber 16Z thus formed, has the result that the volume of liquid confined therein is in effect neutralized as a part of the total turbulence-prone volume within the pump housing and particularly on the side of the partitioning web 16 which is proximate to the inner coupling magnet which is necessarily a major generator of turbulence.

As a further aspect of the foregoing methods and structures, limited migration of the pumped liquid from the impeller chamber into the magnet chamber and reversely is provided for by restrictive liquid passage means in the form of small weep holes 34 through the web 16 and similar holes 36 through the plate permitting the liquid from the pumping chamber for impeller 15 to fill into the neutralizing chamber 16Z and thence into the magnet chamber containing rotor 40 for lubricating and heat-exchange purposes, the fluid passage means 34, 36 nevertheless being sufficiently restrictive to prevent communication of any substantial turbulence effects in either direction through the captive or neutralized volume of liquid, the number and cross-sectional area of such passage formations being determined empirically dependently upon the rated capacity and operating requirements for each type and size of pump and the magnetic drive system employed. The method eliminates restraints in liberally proportioning and disposing needed structural components and configurations which would otherwise contribute to unacceptable levels of turbulence.

While the described divided-flow means has the merit of nearly doubling the volumetric input to the impeller with corresponding increase in output, the flow-dividing structure by reason of molding limitations and variables and the asymmetrical character of the two divergent inflow paths, makes it impossible to maintain zero axial thrust imbalance for the impeller-rotor assembly, thrust from this source alone being sufficient in some cases to cause rapid destruction of thrust bearings.

Another source of axial thrust which can appear in the impeller-magnet-rotor system arises from inherent magnetic reaction characteristics causing the magnet arrays to readjust themselves mutually into magnetic symmetry responsive to variations in speed and load conditions particularly where substantial shaft play is permitted or develops in service. However, thrust from this source can usually be rendered negligible if the magnets in the inner and outer arrays are reasonably well matched and properly positioned relative to each other, it being noted that when thrust of this character does appear, the objectionable component tends to be in the direction away from the impeller toward the magnet chamber, as in the case of thrust from impeller loading imbalance, and in accordance with methods hereafter described, thrust from both sources is alleviated by thrust-compensating means operative to create opposing fluid pressure behind the magnet rotor as a function of rotation thereof.

Referring to FIG. 4, the magnetic coupling means comprises a driven inner magnet assembly including a plastic rotor 40 having hub means 41 with integrally formed web means 41A extending radially thereabout and circumscribed by an integral cylindrical land 43 upon which are seated an array of elongated permanent magnets 44 secured by intervening plastic wedges 45 affixed by screw means to a band 42 encircling the land, the magnets being sealed against liquid contact by a plastic overlay 47.

The rotor 40 and the impeller are carried by the shaft means 25 which is of composite character and comprises an outer plastic sleeve portion formed as an integral part of the impeller 15 and having molded therein a hexagonal aluminum reinforcing insert rod 19.

As shown in FIGS. 1 and 4, the shaft 25 works in two sets of composite bearings respectively situated in the outer hub 17 and inner shaft support 18, the bearing in hub 17 comprising an inner ceramic bushing 22 bonded to the shaft sleeve and an outer plastic type bushing 22A pressed into the bore of the hub 17, the bearing construction in inner support hub 18 being substantially identical except that the innermost sleeve bushing 23 has a shoulder 23A at its outer end to work against a ceramic thrust washer 24 which in turn works against another plastic thrust washer 26 seated in a recess in the proximate end of the rotor hub, which has another recess in its opposite end seating a plastic thrust washer 27 working against a ceramic end thrust washer 28 of ceramic material.

Thus, thrust bearing means is interposed between the magnet rotor and the stationary shaft support 18 at one end of the rotor hub, and between the opposite end of the rotor hub and the proximate endwall of the magnet chamber shell 50. The complete bearing array is shown in FIG. 1.

The pump housing is completed by joinder with the assembled body sections 10 and 12 of the thin-walled separator chamber or shell 50 formed of non-magnetic stainless steel and having flange means 51 clamped with an "O" ring seal 52 into attachment with the web flange formations 16F and corresponding aligned flange formations 10F, 12F on both body sections, all traversed by clamp bolt means 55 extending into flange configurations 71 on a protective bell housing 70 surrounding the outer assembly of driving magnet 64, said bell in turn being affixed to the casing of the driving motor 75 at 76.

From FIG. 4 it will be evident that the pump housing or body structure comprising first, second, and third body sections, 10, 12, and 50, constitute three chamber sections which may be designated respectively as the impeller chamber, the neutralizing chamber, and the magnet chamber, with the neutralizing chamber sealingly clamped or secured between two other body- and cavity-forming members.

Figure 2:
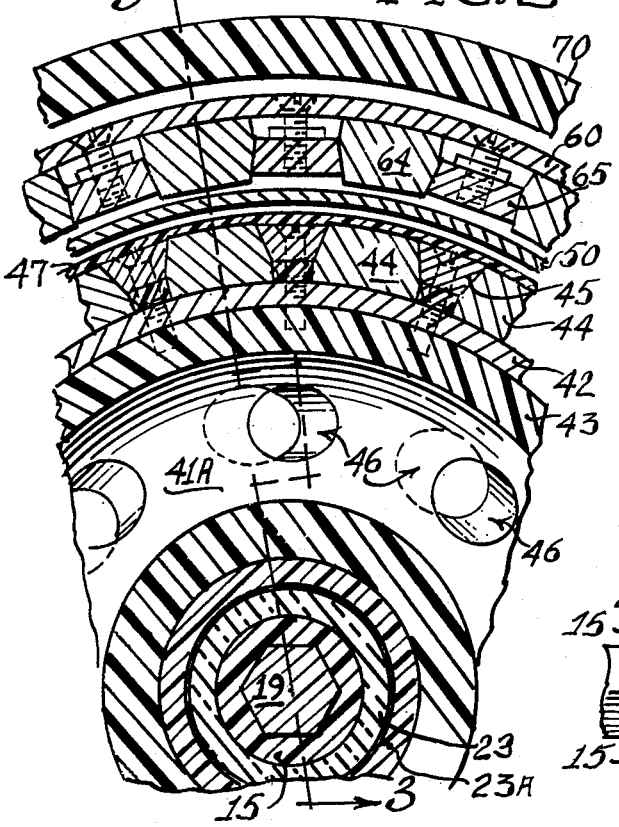
FIG. 2 is a fragmental sectional detail to enlarged scale taken along lines 2—2 of FIG. 1 looking toward the outer and inner coupling magnets.
Figure 3:
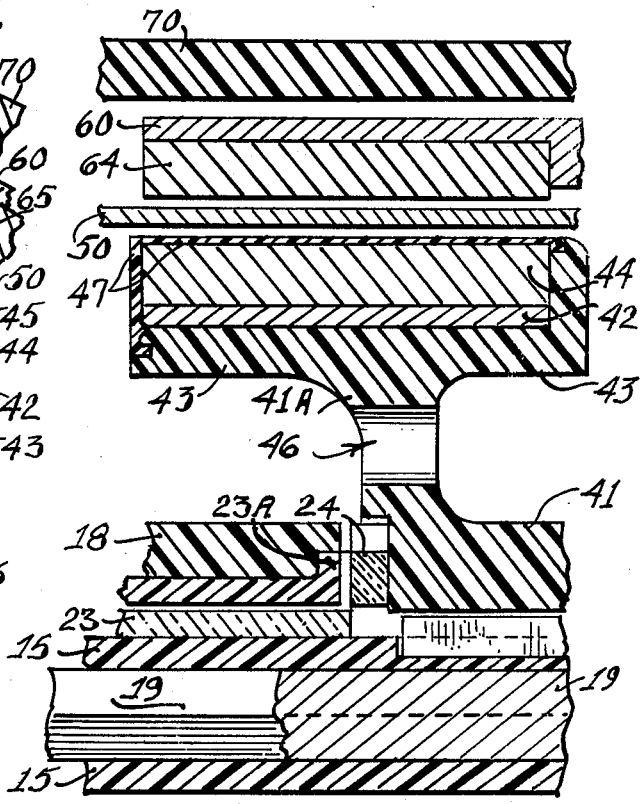
FIG. 3 is an enlarged fragmentary sectional detail through the coupling magnets along lines 3—3 of FIG. 2.

The outer driving magnet assembly comprises a cup-shaped drive magnet carrier 60 having an array of magnets 64 (FIGS. 2 and 3 also) secured to its inner periphery by wedge means 65 in the manner of the inner driven magnet unit, but with the plastic overlay omitted. The carrier has a hub 61 engaged upon the motor shaft 73 and is rotated thereby about the separator shell with very slight clearance between the magnets and the shell in order to minimize the magnetic air gap, the inner magnet array likewise rotating with minimal air-gap clearance of the order of 0.035 in. from the surrounding surfaces of the shell.

The air gap clearance for the inner magnet rotor is sufficiently narrow to restrict liquid flow around the peripheral margins of the rotor to an extent that the rotor tends to respond in the manner of a piston displaced axially within the separator shell in reaction to axial thrust on the shaft caused by magnetic coupling adjustment or variations in fluid pressure within the housing due, for example, to impeller load changes such as previously alluded to caused by inflow imbalance at the impeller inlets, the latter source of thrust, in the larger sizes of pump especially, being destructive of the thrust bearings due to the components of end thrust which, according to these disclosures, are compensated or suppressed by providing fluid passage means through the rotor web 41A having the effect of pumping liquid in behind the rotor to create a counter-pressure urging the rotor and the shaft to which it is affixed in an opposite direction. For such purposes, the rotor passages 46 are pitched, as shown in detail in FIGS. 2, 3, and 6, at an angle of approximately 30° to the shaft axis, it being observed that the angle of pitch and the cross-sectional areas of the passages are empirically determined dependently upon pump size and the parameters of the magnets in the coupling system.

The pump is adapted for use with most caustics, acids, and solvents as the result of molding and encapsulating all vulnerable components exposed to the pumped liquid, such as the body sections 10, 12, impeller 15, shaft means 25, the rotor body 40, of corrosion-resistent plastics materials of the preferred type of glass-filled polyphenylene sulphide resins, the respective composite bearing elements being as stated of ceramic or plastic material filled with metallic bearing content such as molybdenum, while the coupling magnets are of the so-called ceramic type, such as barium ferrite, but may be additionally protected by encapsulation. Exposed metal components, such as the magnet chamber and separator shell 50, are formed of non-corrodible metals such as stainless steel.

It will be evident that the disclosures provide a method for suppressing turbulence in pumps having functional structure and components within the pump exposed to the pump liquid as in the case of duct configurations and shaft and bearing supporting configurations, turbulence being suppressed or modified according to the method by enclosing such components within substantially closed chambered configurations in which the pump fluid is confined with restricted liquid flow into and out of such chambered configurations whereby the confined volume of liquid is effectively isolated from turbulence effects, and neutralized against transmission of turbulence effects from one chamber portion of the housing to another, such as the impeller chamber and magnet rotor chamber; but sufficient restrictive movement of the liquid from one chamber region of the pump to another within the sealed pump housing is nevertheless permitted in degree insufficient to communicate turbulence effects generated within the one portion or chamber of the housing to another by pumping the driving components therein, whereby necessary presence of the pump liquid as for lubricating and heat exchange purposes in certain of said chambers within the pump housing is provided with minimized turbulence effects.

In addition, a method is disclosed for compensating and suppressing ambient axial thrust effects in pumps of the class described in accordance with which the magnetic coupling rotor is constructed with web portions rendering the rotor sensitive to liquid pressure variations within the rotor and pump housing sections tending to shift the rotor axially, and the web configurations are provided with liquid passage means therethrough operative responsive to rotation of the rotor to create pressure effects acting on the rotor to create an axial thrust component opposing axial thrust components acting upon the rotor from pressure variations within the housing and also arising from magnetic coupling sources.

I claim:

1. A high-volume centrifugal pump of the magnetically-coupled type having a pump body housing an impeller driven from an internal shaft connecting with a magnetic coupling rotor in a sealed rotor chamber communicating with the pumped liquid through turbulence-blocking chamber means interposed between the impeller and rotor chambers, characterized in that: the pump body comprises three mating sections of molded plastics material with the first section defining an impeller chamber and volute completed in assembly with configurations on the proximate side of the second section and closing the impeller chamber, said first section having inlet and outlet duct configurations communicating into said impeller chamber and shaft support configurations on an outer side thereof, together with a primary diversionary infeed duct configuration respectively formed as part of said outer side and adapted to feed inflow to the appertaining outer axial side of the impeller adjacent the appertaining shaft support configurations thereof; the second body section having configurations on the side thereof remote from the impeller chamber to define a neutralizing chamber having an open side adapted to confront the open side of the rotor chamber in assembly therewith together with further shaft support configurations and secondary diversionary duct configurations communicating with said inlet duct configurations and feeding inflow to the inner side of the impeller adjacent said further shaft support configurations, said neutralizing chamber being fitted with a third section constituting a closure sealing with the appertaining shaft support configurations and being provided with restricted-flow duct means permitting migration of liquid between said chambers and through said closure while preventing transmission of substantial turbulence effects therebetween.

2. A pump construction according to claim 1 further characterized in that said first and second body sections each have a cylindrical infeeding chamber surrounding the shaft means in adjacency to appertaining shaft support configurations thereof and confronting corresponding axial hub areas of the impeller, and the appertaining diversionary duct configurations each discharge into the corresponding one of said infeeding chambers.

3. In a composite pump body with anti-turbulence means for centrifugal impellers adapted to be fed at both axial sides, mating body sections comprising a first section defining a substantial portion of an impeller chamber with inlet and outlet ducts communicating into said chamber and having formed as a part thereof, but outside said chamber and externally of said body section a primary diversionary duct operative to feed input to the appertaining first side of the impeller from said inlet duct means; a second body section interfitting with said first section to complete and close said impeller chamber and having configurations on the opposite side thereof from the impeller chamber defining an anti-turbulence cavity having a closure therefor adapted to confront the open side of a rotor chamber, said second section having further configurations lying within said cavity defining a secondary diversionary duct operative to feed input to the appertaining second side of the impeller from said inlet duct means; means providing a rotor chamber having an open side confronting said closure of the cavity and having therein a driving rotor interconnecting by shaft means with an impeller in said impeller chamber, said first and second sections each including respective shaft support configurations and bearing means carried thereby, the support configurations and bearing means of the first section being located on a wall portion thereof outwardly away from the impeller chamber, and the support configurations and bearing means of the second section being disposed in part in said cavity and exposed through said cavity closure in substantially liquid tight relationship therewith and in axial alignment with the open side of the rotor chamber and rotor therein.

4. The construction according to claim 3 wherein said rotor has uninterrupted peripheral margins closely spaced from surrounding wall portions of said rotor chamber, and a radial web extending between the hub region of the rotor and said peripheral margins and imparting some axial piston effect to the rotor, and said web is provided with perforate portions of limited cross-sectional area operative to transmit pressure variations in behind the rotor in opposition to alleviate axial thrust tendencies responsive to such variations.

5. The construction of claim 4 further characterized in that said perforate portions are pitched angularly outwardly away from the axis of rotation of the rotor to displace liquid in behind the rotor responsive to rotation thereof to counteract axial thrust effects.

6. A centrifugal pump of the magnetically-coupled type having an impeller adapted to be fed from both axial sides and driven by a coupling rotor contained in a rotor chamber having an open side exposed to the pumped liquid with turbulence suppressing chamber means interposed between the impeller and rotor chambers, said chambers being formed as parts of a pump body comprised of an assembly of mating sections, characterized in that a first body section includes inlet and outlet ducts communicating into an impeller cavity;

a second section includes portions on one side thereof completing and closing said impeller cavity and further portions on an opposite side thereof defining a neutralizing cavity having an open side adapted to confront the open side of the rotor chamber in assembly therewith, together with a third disc-like section closing the open side of said cavity to create a closed neutralizing chamber, said first and second sections having diversionary infeeding duct configurations communicating with said inlet duct and respectively directing inflow to one of the opposite axial sides of the impeller, the diversionary duct configurations of the first section being located on the outside of such section, and the diversionary duct configurations of the second section being located within said neutralizing chamber, said neutralizing chamber being provided with restrictive flow perforations permitting exchange of liquid between the several chambers but preventing transmission from one chamber to another of substantial turbulence effects generated by the impeller and rotor.

7. A pump according to claim 6 further characterized in that said first and second sections each have configurations constituting journaling means for the rotor shaft, and the respective diversionary duct configurations of said sections each discharge into a region extending about the shaft adjacent the respective opposite hub regions of the impeller.

8. A pump structure according to claim 6 further characterized in that each of said first and second sections is provided with an inflow cavity which is circumambient of a shaft supported by the respective shaft-support configurations and the respective diversionary duct configurations each discharge into a corresponding inflow cavity opposite a corresponding axial hub region of the impeller.

9. A pump structure according to claim 6 wherein the diversionary duct configurations of the first section are formed as portions of an outer wall portion thereof, and the diversionary duct configurations of the second section are formed within the neutralizing chamber, whereby said duct configurations are in effect removed as contributory sources of turbulence generation from the turbulence effects produced by the impeller and rotor.

* * * * *